US006959492B1

(12) United States Patent
Matsumoto et al.

(10) Patent No.: US 6,959,492 B1
(45) Date of Patent: Nov. 1, 2005

(54) PLATE TYPE HEAT EXCHANGER AND METHOD OF MANUFACTURING THE HEAT EXCHANGER

(75) Inventors: Satoshi Matsumoto, Kobe (JP); Takeshi Watanabe, Nara (JP); Yoshitsugu Nishiyama, Katano (JP)

(73) Assignee: Matsushita Electric Industrial, Co., Ltd., Osaka (JP)

( * ) Notice: Subject to any disclaimer, the term of this patent is extended or adjusted under 35 U.S.C. 154(b) by 0 days.

(21) Appl. No.: 09/856,531

(22) PCT Filed: Nov. 17, 1999

(86) PCT No.: PCT/JP99/06413

§ 371 (c)(1),
(2), (4) Date: Jul. 3, 2001

(87) PCT Pub. No.: WO00/31487

PCT Pub. Date: Mar. 29, 2001

(30) Foreign Application Priority Data

Nov. 24, 1998 (JP) ..... P 10-332424

(51) Int. Cl.[7] ..... F28F 3/00; B21D 53/04

(52) U.S. Cl. ..... 29/890.039; 29/890.054; 165/135; 165/166; 165/167

(58) Field of Search ..... 165/167, 135, 165/166; 29/890.039, 890.054

(56) References Cited

U.S. PATENT DOCUMENTS 2,221,937 A * 11/1940 Astle ..... 165/167
4,516,632 A * 5/1985 Swift et al. ..... 165/167
5,392,849 A * 2/1995 Matsunaga et al. ..... 165/167
5,409,058 A * 4/1995 Yuasa et al. ..... 165/167
5,429,183 A * 7/1995 Hisamori et al. ..... 165/167
5,644,840 A 7/1997 Hisamori et al.
5,718,286 A * 2/1998 Damsohn et al. ..... 165/167
5,758,418 A * 6/1998 Chrysler et al. ..... 29/890.03
5,761,811 A * 6/1998 Ito ..... 29/890.054
5,836,383 A 11/1998 Zwittig

FOREIGN PATENT DOCUMENTS

| | | | | |
|---|---|---|---|---|
| DE | 197 07 648 | | 8/1998 | |
| FR | 2184536 | | 12/1973 | |
| FR | 2572798 | A1 * | 5/1986 | ..... 29/890.039 |
| JP | 62258992 | A * | 11/1987 | |
| JP | 01014595 | A * | 1/1989 | |
| JP | 2-133569 | | 11/1990 | |
| JP | 2-306097 | | 12/1990 | |
| JP | 03008561 | A * | 1/1991 | |
| JP | 6-14775 | | 2/1994 | |
| JP | 6-313686 | | 11/1994 | |
| JP | 8-178558 | | 7/1996 | |
| JP | 09178384 | A * | 7/1997 | |
| JP | 10-141820 | | 5/1998 | |

* cited by examiner

*Primary Examiner*—Leonard R. Leo
(74) *Attorney, Agent, or Firm*—Wenderoth, Lind & Ponack, L.L.P.

(57) ABSTRACT

A plate heat exchanger includes a plurality of plates sandwiched between a pair of end plates. Each of the plurality of plates has two passageways defined therein that are not in fluid communication with each other. Alternatively, some of the plurality of plates have a passageway, while some of the remaining plates have another passageway. Two fluids flow through the two passageways in a countercurrent fashion. Because the countercurrent flows are superior in heat transfer efficiency, it is possible to enhance the performance and reduce the size of the plate heat exchangers.

9 Claims, 8 Drawing Sheets

PLATE TYPE HEAT EXCHANGER AND METHOD OF MANUFACTURING THE HEAT EXCHANGER

TECHNICAL FIELD

The present invention relates to plate heat exchangers employing, as heat exchange fluids, a liquid and a two-phase fluid undergoing a phase change in vapor and liquid phases to exchange heat between the liquid and two-phase fluid.

BACKGROUND ART

The plate heat exchangers generally include a stack of metal plates having separated passageways defined therein through which heat exchange fluids flow to exchange heat therebetween. The plate heat exchangers have a large surface area per volume and can be made compact. Because they can be made with a lesser amount of material, they gradually surpass tube and shell heat exchangers in use. In ordinary plate heat exchangers, outer peripheral portions of the plates or header holes are sealed with gaskets, and the plates are mechanically fixed. Although they can be taken apart and cleaned, they have the disadvantage of being limited in the range of temperature or pressure of the fluids to be used.

Japanese Laid-Open Patent Publication No. 63-137793 discloses an improved plate heat exchanger that can overcome the above-described problem inherent in the ordinary plate heat exchangers. This heat exchanger includes metal plates piled up one upon the other, in which fluid passageways are formed by punching and each of them is defined within the thickness of a metal plate. This heat exchanger has the same advantages as those of the ordinary plate heat exchangers, and because the metal plates having the fluid passageways are completely secured together, the heat exchanger does not impose a large limitation in the range of temperature or pressure of the fluids to be used.

FIG. 8 depicts such a plate heat exchanger, a portion of which is taken apart for ease of understanding. As shown therein, the plate heat exchanger includes a plurality of passageway plates 81 each having passageways 86 defined therein as penetrations, and includes a plurality of passageway plates 82 each similarly having passageways 87 defined therein as penetrations. All of the plates are piled up alternately with a partition plate 83 interposed between adjacent passageway plates 81, 82. A stack of these plates 81, 82, 83 is sandwiched between a pair of end plates 84, 85.

Each passageway plate 81 has through-holes 92*a*, 92*b* defined therein in addition to the passageways 86, while each passageway plate 82 similarly has through-holes 95*a*, 95*b* defined therein in addition to the passageways 87. Each partition plate 83 has through-holes 93*a*, 93*b*, 94*a*, 94*b* defined therein. The end plate 84 has inlet and outlet pipes 88, 89 for a heat exchange fluid A, and inlet and outlet pipes 90, 91 for another heat exchange fluid B, all of which are secured thereto. The passageways 86 in each passageway plate 81 and the passageways 87 in the adjacent passageway plate 82 are separated by a partition plate 83 and cross at right angles.

The heat exchange fluid A enters the heat exchanger through the inlet pipe 88 secured to the end plate 84, passes through the through-holes 94*a*, 95*a*, and enters the passageways 86 formed in the passageway plates 81. The heat exchange fluid A that has passed through the passageways 86 is discharged from the heat exchanger via the through-holes 95*b*, 94*b* and then via the outlet pipe 89. On the other hand, the heat exchange fluid B enters the heat exchanger through the inlet pipe 90 secured to the end plate 84, passes through the through-holes 92*a*, 93*a*, and enters the passageways 87 formed in the passageway plates 82. The heat exchange fluid B that has passed through the passageways 87 is discharged from the heat exchanger via the through-holes 93*b*, 92*b* and via the outlet pipe 91. At this moment, the heat exchange fluid A flowing through the passageways 86 exchanges heat, through two partition plates 83 disposed above and below it, with the heat exchange fluid B flowing through the passageways 87.

The conventional plate heat exchanger of the above-described construction has the following drawbacks.

Because the heat exchange fluids A, B form cross- or rectangular-current flows that are in a heat exchange relationship, and because the cross- or rectangular-current flows are inferior in heat transfer efficiency to countercurrent flows, the conventional plate heat exchanger referred to above requires a heat transfer area greater than that required by a heat exchanger of the countercurrent flow type to obtain a predetermined heat transfer capacity, resulting in an increase in size of the heat exchanger. In order to enhance the heat transfer ability on the side of the heat exchange fluid A in the heat exchanger, if the heat transfer area is increased by elongating the passageways 86, it becomes necessary for the passageways 87 adjoining them via the partition plates 83 to be increased in number or in width. In either case, the total sectional area of the passageways 87 increases, and the speed of the heat exchange fluid B decreases, resulting in a reduction in the heat transfer ability of the heat exchange fluid B.

Diffused junction, bonding, brazing or the like is preferably employed to join the plates together in the plate heat exchanger.

In the diffused junction, a stack of plates is pressurized under vacuum and heated to a temperature slightly less than the melting point of the material of the plates. Because the plates are joined together by virtue of diffusion of the material in the vicinity of the mating surfaces of the plates, a considerably large load is required for the application of pressure during joining, thus requiring relatively large pressure equipment. Accordingly, it is difficult to mass-produce the plate heat exchangers at a low cost.

Bonding is generally carried out by first coating the bonding surfaces of the plates with, for example, an epoxy-based bonding agent, and by subsequently conducting heat curing treatment on the plates that have been piled up one upon the other. Because the joining by bonding is poor in pressure resistance or heat resistance of the bonded portions, the use pressure or temperature of the heat exchangers is considerably limited.

On the other hand, brazing is generally carried out by first coating the bonding surfaces of the plates with a solder or brazing material having a melting point lower than that of the plates, and by subsequently heating the plates, which have been piled up one upon the other, to a temperature greater than the melting point of the solder. The melted solder is diffused into the plates to join them.

In view of the manufacturing equipment or pressure resistance of the heat exchangers, brazing is generally employed in joining the plates. However, if the degree of contact between the neighboring plates during brazing is bad, a gap or gaps are created in the brazed portions of the plates, thus causing leakage of the heat exchange fluids. By way of example, passageways or through-holes are formed in the passageway plates or the partition plates by pressing or punching and, hence, burrs are formed on the processed portions of the plates in the direction of pressing or punching. When the plates are piled up, contact of such burrs considerably deteriorates the degree of contact between the neighboring plates, resulting in poor brazing.

SUMMARY OF THE INVENTION

The present invention has been developed to overcome the above-described disadvantages.

It is accordingly an objective of the present invention to provide a small-sized inexpensive plate heat exchanger having an enhanced performance and a method of making the same, in which two fluids that are in a heat exchange relationship flow in opposite directions.

Another objective of the present invention is to provide a plate heat exchanger having enhanced reliability and a method of making the same, in which the mechanical strength required for a pressure vessel is increased or the plates are positively secured together.

In accomplishing the above and other objectives, the plate heat exchanger of the present invention includes a pair of end plates extending parallel to each other. A plurality of plates are sandwiched between the pair of end plates and have two passageways defined therein that are not in fluid communication with each other, and two fluids flow through the two passageways in a countercurrent fashion.

Because the countercurrent flows are superior in heat transfer efficiency, it is possible to enhance the performance and reduce the size of the plate heat exchangers.

The plurality of plates may include a plurality of first passageway plates each having a first passageway defined therein, a plurality of second passageway plates each having a second passageway defined therein, and a plurality of partition plates. The plurality of first passageway plates and the plurality of second passageway plates are piled up alternately with one of the plurality of partition plates interposed between neighboring first and second passageway plates. The first and second passageways are aligned with each other, and first and second fluids flow through the first and second passageways, respectively, in the countercurrent fashion.

In the above-described construction, if the partition plates are thicker than the first or second passageway plates, the mechanical strength required for a pressure vessel is increased, thus enhancing the reliability of the plate heat exchangers.

Furthermore, if the first and second passageway plates have an identical shape, the same plates can be commonly used therefor. Accordingly, the plate structure is extremely simplified, making it possible to further reduce the manufacturing cost of the plate heat exchangers.

Alternatively, each of the plurality of plates may be a passageway plate having first and second passageways defined therein that adjoin and extend parallel to each other, wherein first and second fluids flow through the first and second passageways, respectively, in the countercurrent fashion.

By this construction, because the first and second fluids exchange heat in the countercurrent fashion and because the plate structure is simplified, it is possible to enhance the performance of the plate heat exchangers and reduce the manufacturing cost and size of the plate heat exchangers.

If the plurality of plates are shaped by pressing and piled up so that punching directions thereof during pressing coincide, contact of burrs that have been created on the plates by pressing is avoided. As a result, the degree of contact between the plates is enhanced, thus increasing the yield during manufacture of the plate heat exchangers.

A partition may be provided in at least one of the first and second passageways to divide it into two in a widthwise direction thereof. This construction reduces the width and sectional area of the passageway and increases the speed of the fluid that flows therethrough, thus enhancing the heat transfer efficiency. Also, the provision of the partition increases the mechanical strength required for the heat exchangers as pressure vessels and, hence, the performance and reliability of the plate heat exchangers are further enhanced.

Conveniently, the first and second passageways have generally U-shaped turning portions. By this construction, even if the passageways are extremely long, the length or width of the heat exchangers can be considerably reduced, resulting in compact plate heat exchangers. If at least one of the first and second passageways has substantially the same width in the direction of length thereof, the fluid flows smoothly therethrough. Accordingly, deterioration in heat transfer efficiency that has been hitherto caused by a stay of fluid is prevented, thus further enhancing the performance of the plate heat exchangers.

Each of the plurality of passageway plates may have a through-hole defined therein between adjoining fluid paths of each of the first and second passageways. In this case, the through-holes of the plurality of passageway plates communicate with one another. By this construction, because heat transfer between the same fluid in the adjoining fluid paths is completely blocked, the performance of the plate heat exchangers is further enhanced.

If the plurality of passageway plates are made of resinous material, the weight of the plate heat exchangers is reduced. In this case, if the partition plates that provide heat transfer surfaces are formed of metallic material or resinous material such as graphite having a high heat transfer rate, the performance of the heat exchangers is not reduced.

In another aspect of the present invention, a method of making a plate heat exchanger is characterized by shaping the plurality of plates by pressing, performing plating on opposite surfaces of at least some of the plurality of plates, piling up the plurality of plates so that punching directions thereof during pressing coincide, and heating the plurality of plates under the condition in which the plurality of plates are held in close contact with one another.

According to this method, when the plates are piled up, contact of burrs formed thereon during pressing is avoided and, hence, the degree of contact between the plates is enhanced. Accordingly, the plates are positively joined together by plating and subsequent brazing, making it possible to enhance the yield and provide reliable plate heat exchangers.

Alternatively, the step of performing plating may be replaced by the step of coating with paste solder those surfaces of the plurality of plates that are positioned on an upstream side thereof in a punching direction during pressing. The use of the paste solder that is cheaper than plating reduces the manufacturing cost of the plate heat exchangers. Also, because the solder is coated on the upstream side surfaces of the plates with respect to the punching direction during pressing, i.e., on the surfaces of the plates on which no burrs project, jigs or tools such as masks to be used during coating are not appreciably damaged by the burrs, thus enhancing the reliability of the plate heat exchangers.

DETAILED DESCRIPTION OF THE INVENTION

Preferred embodiments of the present invention are described hereinafter with reference to the drawings.

Embodiment 1

Figure 1:
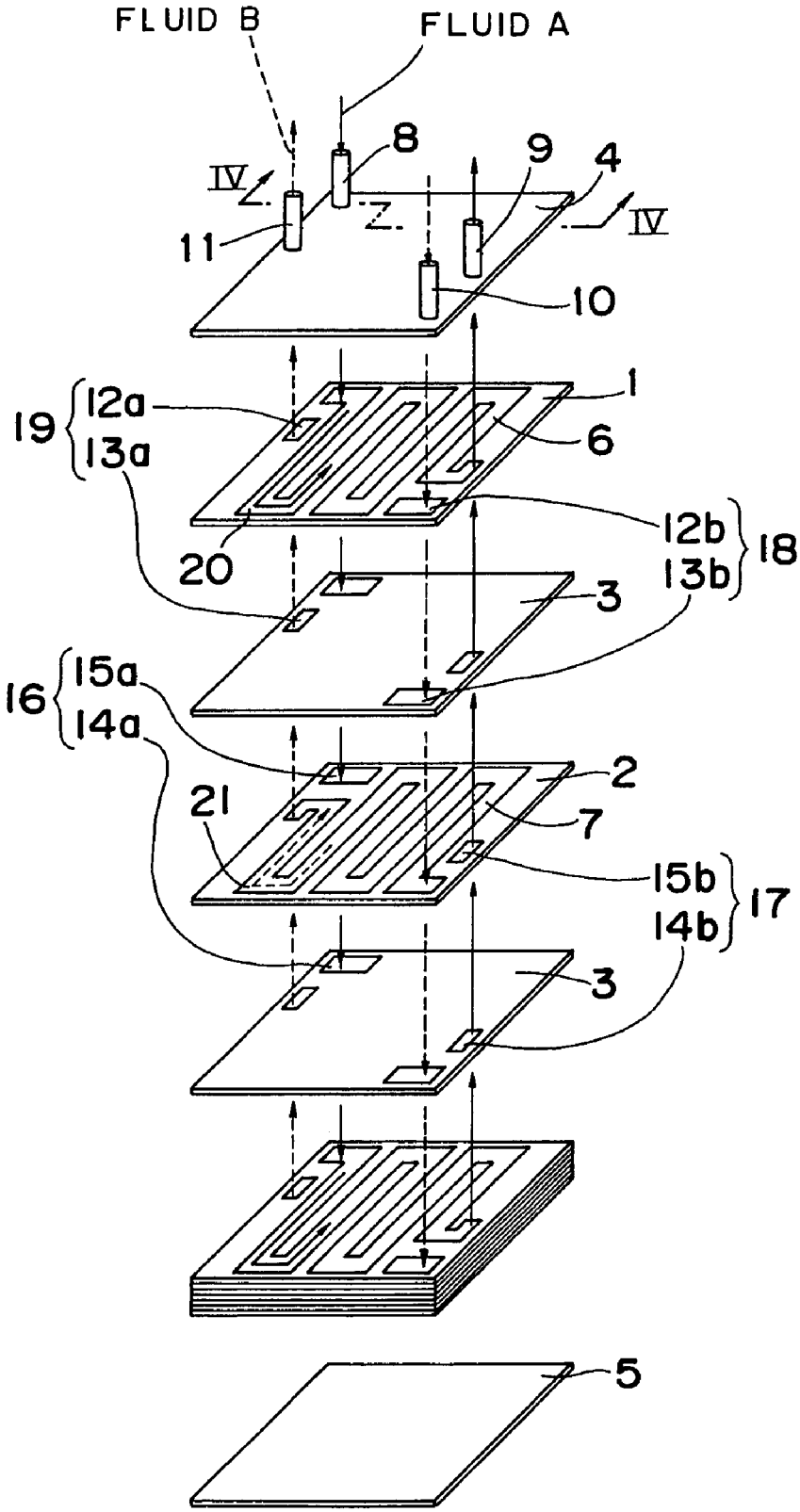
FIG. 1 is an exploded perspective view of a plate heat exchanger according to a first embodiment of the present invention.

FIG. 1 depicts a plate heat exchanger according to a first embodiment of the present invention, with a portion thereof taken apart for ease of understanding of the interior structure thereof.

This plate heat exchanger includes a plurality of plates sandwiched between a pair of end plates extending parallel to each other, with a plurality of separate passageways defined in some of the plates. The plurality of passageways are not in fluid communication with each other and are defined in different plates. The directions of flow of fluids in the plurality of passageways are essentially opposite to each other.

More specifically, as shown in FIG. 1, a plurality (first group) of passageway plates 1 each having a passageway 6 defined therein as a penetration for the passage of a heat exchange fluid A and a plurality (second group) of passageway plates 2 each having a passageway 7 defined therein as a penetration for the passage of a heat exchange fluid B are piled up (stacked) alternately and sandwiched between a pair of end plates 4, 5, with a partition plate 3 interposed between adjacent passageway plates 1, 2. The passageways 6, 7 are aligned with each other with a partition plate 3 interposed therebetween. The directions of flow of the heat exchange fluid A in the passageways 6 and the heat exchange fluid B in the passageways 7 are countercurrent (opposite) with respect to each other.

Each passageway plate 1 has through-holes 12*a*, 12*b* defined therein in addition to the passageway 6, while each passageway plate 2 similarly has throughholes 15*a*, 15*b* defined therein in addition to the passageway 7. Each partition plate 3 has through-holes 13*a*, 13*b*, 14*a*, 14*b* defined therein. When the passageway plates 1, 2 are piled up with a partition plate 3 interposed therebetween, an inlet header or space 16 for the heat exchange fluid A is formed by a portion of each passageway 6 and the through-holes 14*a*, 15*a*. An outlet header 17 for the heat exchange fluid A, an inlet header 18 for the heat exchange fluid B, and an outlet header 19 for the heat exchange fluid B are similarly formed.

The end plate 4 has inlet and outlet pipes 8, 9 for the heat exchange fluid A, and inlet and outlet pipes 10, 11 for the heat exchange fluid B, all of which are secured thereto. The inlet and outlet pipes 8, 9 are in fluid communication with the inlet and outlet headers 16, 17 for the heat exchange fluid A, respectively. Similarly, the inlet and outlet pipes 10, 11 are in fluid communication with the inlet and outlet headers 18, 19 for the heat exchange fluid B, respectively.

As shown by a solid arrow in the figure, the heat exchange fluid A enters the inlet header 16 through the inlet pipe 8 secured to the end plate 4, and then enters the passageways 6 formed in the passageway plates 1. The heat exchange fluid A that has passed through the passageways 6 is collected in the outlet header 17 and is discharged outside through the outlet pipe 9. On the other hand, as shown by a dotted arrow in the figure, the heat exchange fluid B enters the inlet header 18 through the inlet pipe 10 secured to the end plate 4, and then enters the passageways 7 formed in the passageway plates 2. The heat exchange fluid B that has passed through the passageways 7 is collected in the outlet header 19 and is discharged outside through the outlet pipe 11. At this moment, the heat exchange fluid A flowing through each passageway 6 exchanges heat, through the two partition plates 3 15 disposed above and below it, with the heat exchange fluid B flowing through the passageways 7.

As shown in FIG. 1, because all the passageways 6 and the passageways 7 are aligned with or confront each other except in the vicinity of the headers with a partition plate 3 interposed between the neighboring passageways 6, 7, the heat exchange fluids A, B exchange heat in a countercurrent fashion. In general, the countercurrent flows are superior in heat transfer efficiency to the cross- or rectangular-current flows or the parallel flows as employed in the conventional plate heat exchangers. Accordingly, the countercurrent flows between the heat exchange fluids A, B make it possible to enhance the performance and reduce the size of the plate heat exchangers.

It is to be noted here that although in the above-described construction the partition plates 3 may have the same thickness as the passageway plates 1, 2, the partition plates 3 may be thicker than one of the passageway plates 1, 2.

More specifically, in the plate heat exchangers having passageways each extending across the thickness of a plate, the thickness of the passageway plates 1 corresponds to the height of the passageways 6 and is a factor in determining the speed of the heat exchange fluid A flowing through the passageways 6. On the other hand, the thickness of the partition plates 3 that are heat transfer surfaces during heat exchange between the heat exchange fluids A, B is a factor in determining the heat resistance during the heat exchange and also in determining the pressure resistance of the heat exchangers. In designing the plate heat exchangers particularly in view of the pressure resistance thereof, the operating pressures of the heat exchange fluids A, B, the physical properties of the plate material, and the partition wall configurations (width, thickness) of the portions that form the passageways are parameters to be taken into account.

Accordingly, the mechanical strength required for a pressure vessel can be enhanced by making the partition plates 3 thicker than at least one of the passageway plates 1, 2, resulting in reliable plate heat exchangers.

Furthermore, the passageway plates 1, 2 may have the same shape. That is, the passageway plates 2 may be the same plates as the passageway plates 1, but arranged so as to be turned 180° in a horizontal plane with respect to the passageway plates 1 when the passageway plates 1, 2 are piled up with a partition plate 3 interposed between the neighboring passageway plates 1, 2. If the passageway plates 2 are turned 180° in respective horizontal planes with respect to plates 1, the passageways 7 and the through-holes 15*a*, 15*b* in the passageway plates 2 completely conform in configuration to the passageways 6 and the through-holes 12*b*, 12*a* in the passageway plates 1, respectively.

Accordingly, if the passageway plates 1, 2 are identical in shape, the same plates can be commonly used for the passageway plates 1, 2. As a result, the plate structure is considerably simplified, making it possible to reduce the manufacturing cost of the plate heat exchangers.

It is preferred that the external shapes of the passageway plates 1, 2 and the partition plates 3, and the passageways and through-holes in the passageway plates 1, 2 and the partition plates 3 are shaped by pressing, and all the plates are piled up so that the punching directions thereof during pressing may coincide.

In general, when through-holes are formed in plates by pressing, projections or burrs are formed along the contour of the through-holes. Such burrs are created on a plate surface positioned on the downstream side of the plates with respect to the punching direction during the pressing. When the plates are piled up, if the burrs on a plate are brought into contact with those on adjacent plates, the degree of contact between the plates is deteriorated, resulting in poor joining. However, if the piling (stacking) is carried out so that the punching directions may coincide, the contact of the burrs from adjacent plates is avoided and the degree of contact between the plates is enhanced, making it possible to increase the yield during the manufacture of the plate heat exchangers.

As shown in FIG. 1, each of the passageways 6, 7 has generally U-shaped turning portions 20, 21. The provision of such turning portions 20, 21 makes it possible to form not only straight passageways but passageways of any other shapes such as, for example, rectangular passageways or spiral passageways in the plates. This means that even if the passageways are extremely long, the length or width of the heat exchangers can be considerably reduced, resulting in compact plate heat exchangers.

Figure 2:
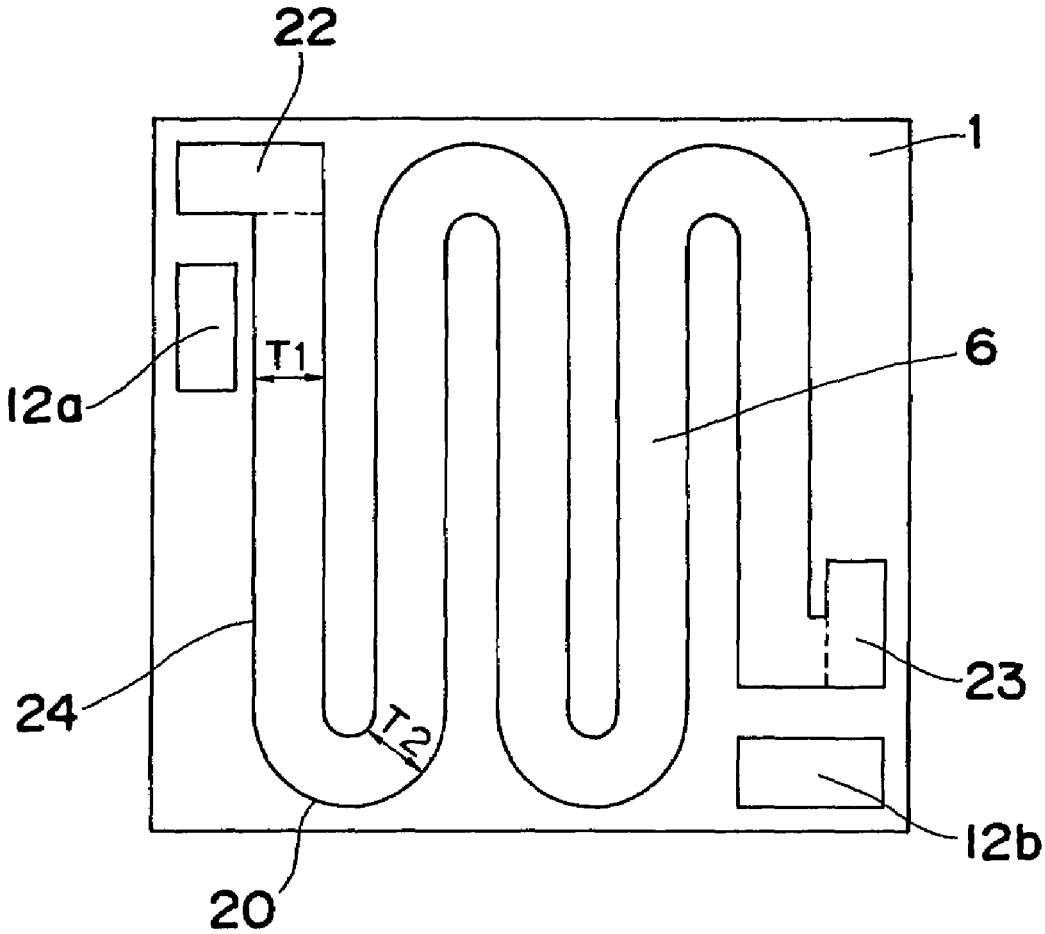
FIG. 2 is a top plan view of a passageway plate mounted in the plate heat exchanger of FIG. 1.

Furthermore, as shown in FIG. 2, either the passageways 6 or the passageways 7, or both of them, may have substantially the same width along the length thereof (FIG. 2 particularly depicts the passageways 6).

The passageways 6 have header portions 22, 23 formed on opposite sides thereof, and each header portion constitutes a portion of the inlet or outlet header for the heat exchange fluid A. The passageways 6 also have straight portions 24 and turning portions 20, both of which are in fluid communication with the header portions 22, 23. The width T1 of the straight portions 24 and the width T2 of the turning portions 20 are set to be substantially the same. This applies to the passageways for the heat exchange fluid B.

If the width of the passageways is not substantially the same along the length thereof and, in particular, if the turning portions of the passageways have a rectangular shape, this means that corners exist in the passageways. When the heat exchange fluid passes the corners, it is hindered from flowing smoothly, and a portion of the fluid is apt to stay at such corners. This phenomenon hinders heat exchange between the passageways through the partition plates and deteriorates the performance of the heat exchangers.

If the width of the passageways 6 is substantially the same along the length thereof, in particular, at the straight portions 24 and at the turning portions 20, the heat exchange fluid A flows smoothly without staying at the turning portions 20 of the passageways 6, thus further enhancing the performance of the plate heat exchangers. The same is true for the passageways 7 that confront the passageways 6.

Embodiment 2

Figure 3:
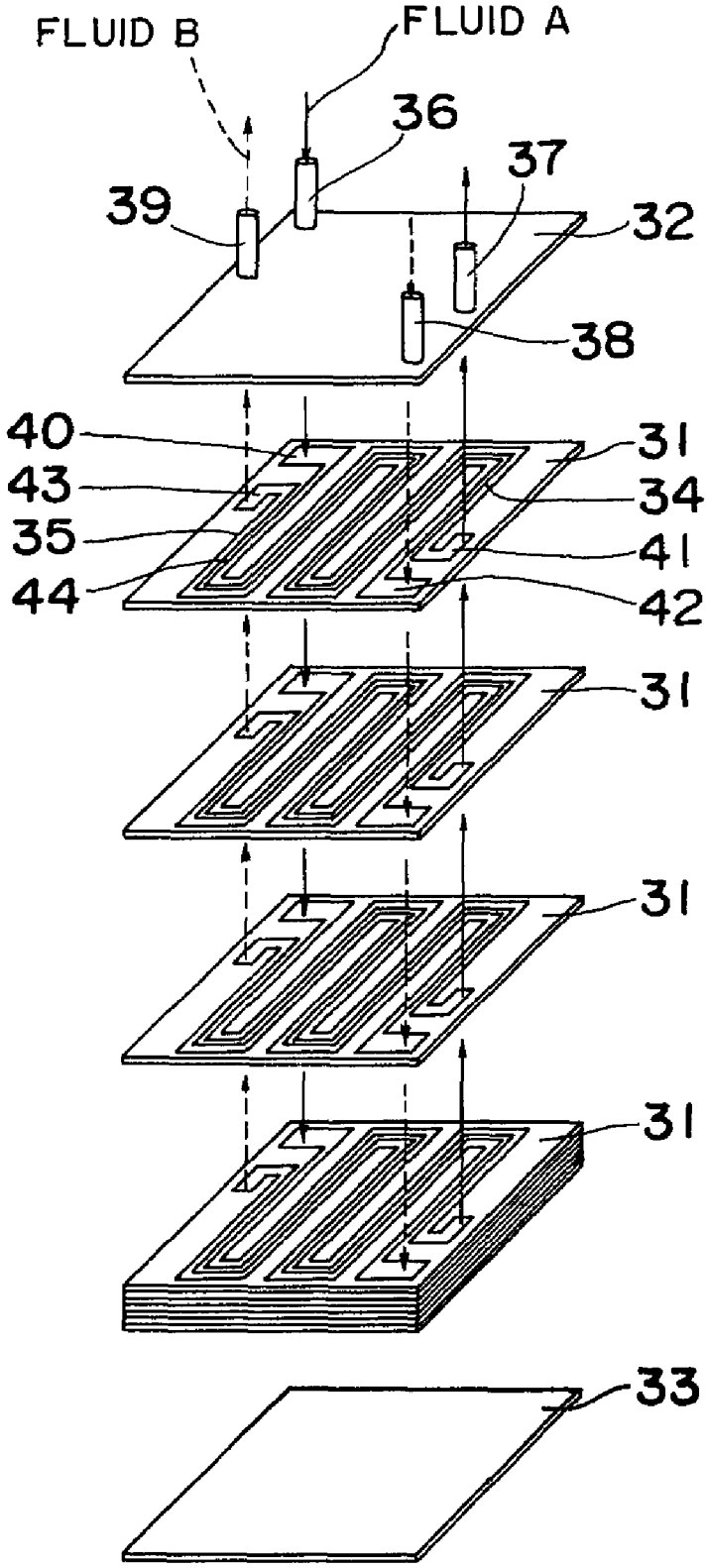
FIG. 3 is an exploded perspective view of a plate heat exchanger according to a second embodiment of the present invention.

FIG. 3 depicts a plate heat exchanger according to a second embodiment of the present invention:

This plate heat exchanger includes a plurality of plates sandwiched between a pair of end plates and each having a plurality of separate passageways defined therein as penetrations that are not in fluid communication with each other. The directions of flow of fluids in the plurality of passageways are essentially opposite to each other.

More specifically, as shown in FIG. 3, a plurality of passageway plates 31 each having passageways 34, 35 defined therein as penetrations are piled up (stacked) one upon the other and sandwiched between a pair of end plates 32, 33. The passageways 34, 35 adjoin and extend parallel to each other to form respective boustrophedonic fluid paths. The directions of flow of the heat exchange fluid A in the passageways 34 and the heat exchange fluid B in the passageways 35 are countercurrent (opposite) with respect to each other.

Each passageway plate 31 has an inlet header 40 and an outlet header 41 formed at opposite ends of the passageway 34, and also has an inlet header 42 and an outlet header 43 formed at opposite ends of the passageway 35.

The end plate 32 has inlet and outlet pipes 36, 37 for the heat exchange fluid A, and inlet and outlet pipes 38, 39 for the heat exchange fluid B, all of which are secured thereto. The inlet and outlet pipes 36, 37 are in fluid communication with the inlet and outlet headers 40, 41 for the heat exchange fluid A, respectively. Similarly, the inlet and outlet pipes 38, 39 are in fluid communication with the inlet and outlet headers 42, 43 for the heat exchange fluid B, respectively.

The heat exchange fluid A enters the inlet header 40 through the inlet pipe 36 secured to the end plate 32, and then enters the passageways 34 formed in the passageway plates 31. The heat exchange fluid A that has passed through the passageways 34 is collected in the outlet header 41 and is discharged outside through the outlet pipe 37. On the other hand, the heat exchange fluid B enters the inlet header 42 through the inlet pipe 38 secured to the end plate 32, and then enters the passageways 35 formed in the passageway plates 31. The heat exchange fluid B that has passed through the passageways 35 is collected in the outlet header 43 and is discharged outside through the outlet pipe 39. At this moment, the heat exchange fluid A flowing through the passageways 34 exchanges heat, through partitions 44 positioned between the passageways 34, 35, with the heat exchange fluid B flowing through the passageways 35.

As shown in FIG. 3, because all the passageways 34 and the passageways 35 adjoin and confront each other except in the vicinity of the headers with the partitions 44 interposed therebetween, the heat exchange fluids A, B exchange heat in a countercurrent fashion.

Because the plate heat exchanger of the above-described construction does not require the partition plates as shown in FIG. 1, but requires only the passageway plates 31, and because all the passageway plates 31 have the same shape, the plate structure can be simplified, making it possible to enhance the performance of the plate heat exchangers and to reduce the size and manufacturing cost of the plate heat exchangers.

As is the case with Embodiment 1, the degree of contact between the plates can be enhanced by shaping the passageway plates 31 by pressing, and by piling up (stacking) all the plates so that the punching directions thereof during pressing may coincide.

Moreover, as is the case with Embodiment 1, the provision of the generally U-shaped turning portions in the passageways 34, 35 can further reduce the size of the plate heat exchangers. Also, if either the passageways 34 or the passageways 35, or both of them, have substantially the same width in the direction of length of the passageways, the performance of the plate heat exchangers is further enhanced.

Embodiment 3

Figure 4:
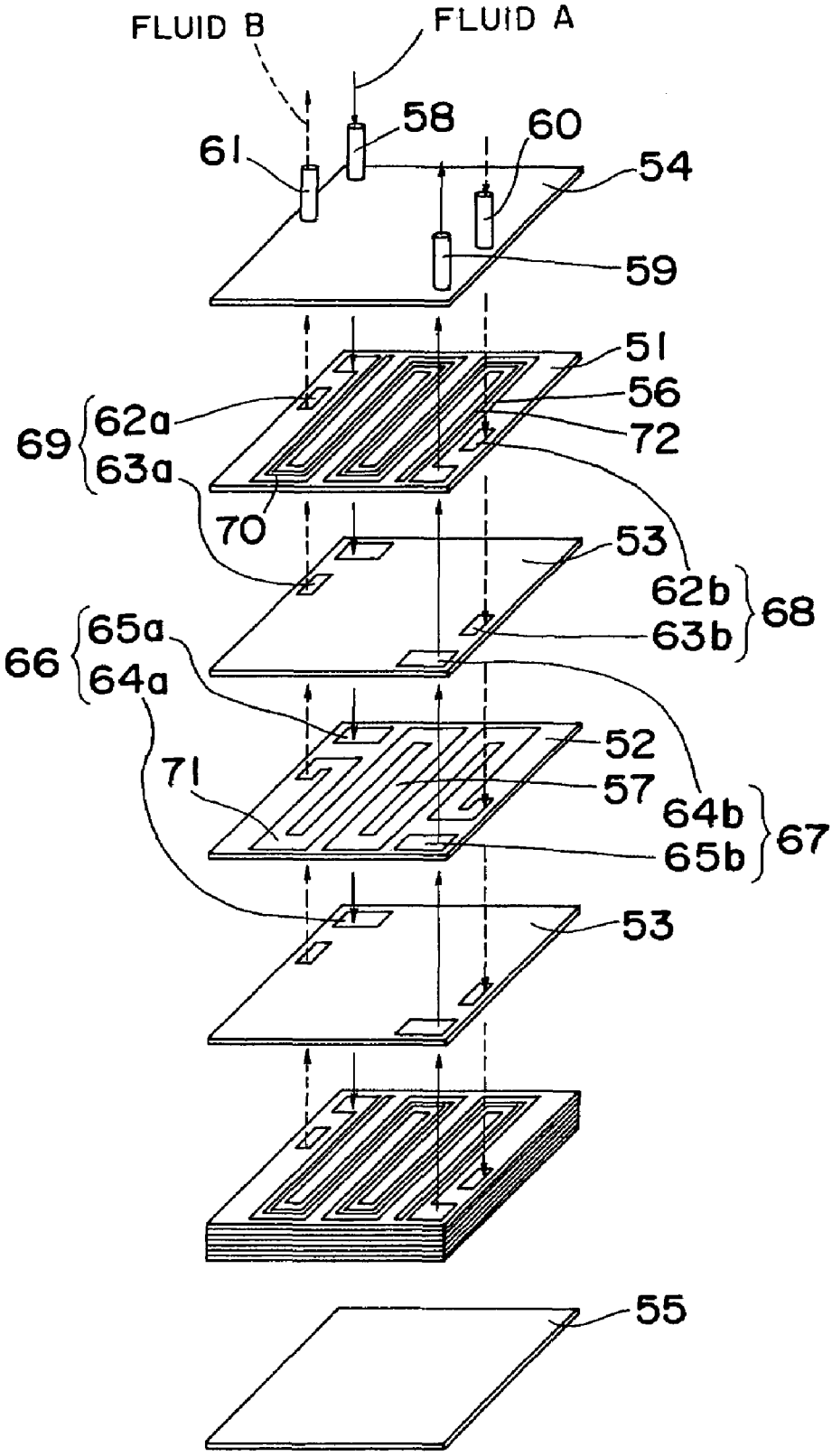
FIG. 4 is an exploded perspective view of a plate heat exchanger according to a third embodiment of the present invention.

FIG. 4 depicts a plate heat exchanger according to a third embodiment of the present invention.

This plate heat exchanger includes a plurality (first group) of passageway plates 51 each having a passageway 56 defined therein as a penetration for the passage of a heat exchange fluid A, and a plurality (second group) of passageway plates 52 each having a passageway 57 defined therein as a penetration for the passage of a heat exchange fluid B. These passageway plates 51, 52 are piled up (stacked) alternately and sandwiched between a pair of end plates 54, 55, with a partition plate 53 interposed between adjacent passageway plates 51, 52. The passageway 56 in each passageway plate 51 is divided into two sections in the widthwise direction thereof by a partition member 72.

Each passageway plate 51 has through-holes 62*a*, 62*b* defined therein in addition to the passageway 56, while each passageway plate 52 similarly has through-holes 65*a*, 65*b* defined therein in addition to the passageway 57. Each partition plate 53 has through-holes 63*a*, 63*b*, 64*a*, 64*b* defined therein. When the passageway plates 51, 52 are piled up (stacked) with a partition plate 53 interposed therebetween, an inlet header or space 66 for the heat exchange fluid A is formed by a portion of each passageway 56 and the through-holes 64*a*, 65*a*. An outlet header 67 for the heat exchange fluid A, an inlet header 68 for the heat exchange fluid B, and an outlet header 69 for the heat exchange fluid B are similarly formed.

The end plate 54 has inlet and outlet pipes 58, 59 for the heat exchange fluid A, and inlet and outlet pipes 60, 61 for the heat exchange fluid B, all of which are secured thereto. The inlet and outlet pipes 58, 59 are in fluid communication with the inlet and outlet headers 66, 67 for the heat exchange fluid A, respectively. Similarly, the inlet and outlet pipes 60, 61 are in fluid communication with the inlet and outlet headers 68, 69 for the heat exchange fluid B, respectively.

The heat exchange fluid A enters the inlet header 66 through the inlet pipe 58 secured to the end plate 54, and then enters the passageways 56 formed in the passageway plates 51. The heat exchange fluid A that has passed through the passageways 56 is collected in the outlet header 67 and is discharged outside through the outlet pipe 59. On the other hand, the heat exchange fluid B enters the inlet header 68 through the inlet pipe 60 secured to the end plate 54, and then enters the passageways 57 formed in the passageway plates 52. The heat exchange fluid B that has passed through the passageways 57 is collected in the outlet header 69 and is discharged outside through the outlet pipe 61. At this moment, the heat exchange fluid A flowing through each passageway 56 exchanges heat, through the two partition plates 53 disposed above and below it, with the heat exchange fluid B flowing through the passageways 57.

As shown in FIG. 4, the provision of the partition member 72 for dividing the passageway 56 into two sections in the widthwise direction thereof reduces the full width and the sectional area of the passageway 56. Therefore, the speed of the heat exchange fluid A that flows through the passageway 56 is increased. In general, an increase in speed of the fluid enhances the heat transfer efficiency. Also, the provision of the partition member 72 enlarges the joining area between the passageway plate 51 and the partition plate 53, thus increasing the mechanical strength required for the heat exchangers as pressure vessels.

Accordingly, the above-described construction further enhances the performance and reliability of the plate heat exchangers.

In the plate heat exchanger shown in FIG. 3, the same effects can also be obtained if a partition is provided in at least one of each passageway 34 or each passageway 35 to divide it into two sections in the widthwise direction thereof.

Embodiment 4

Figure 5:
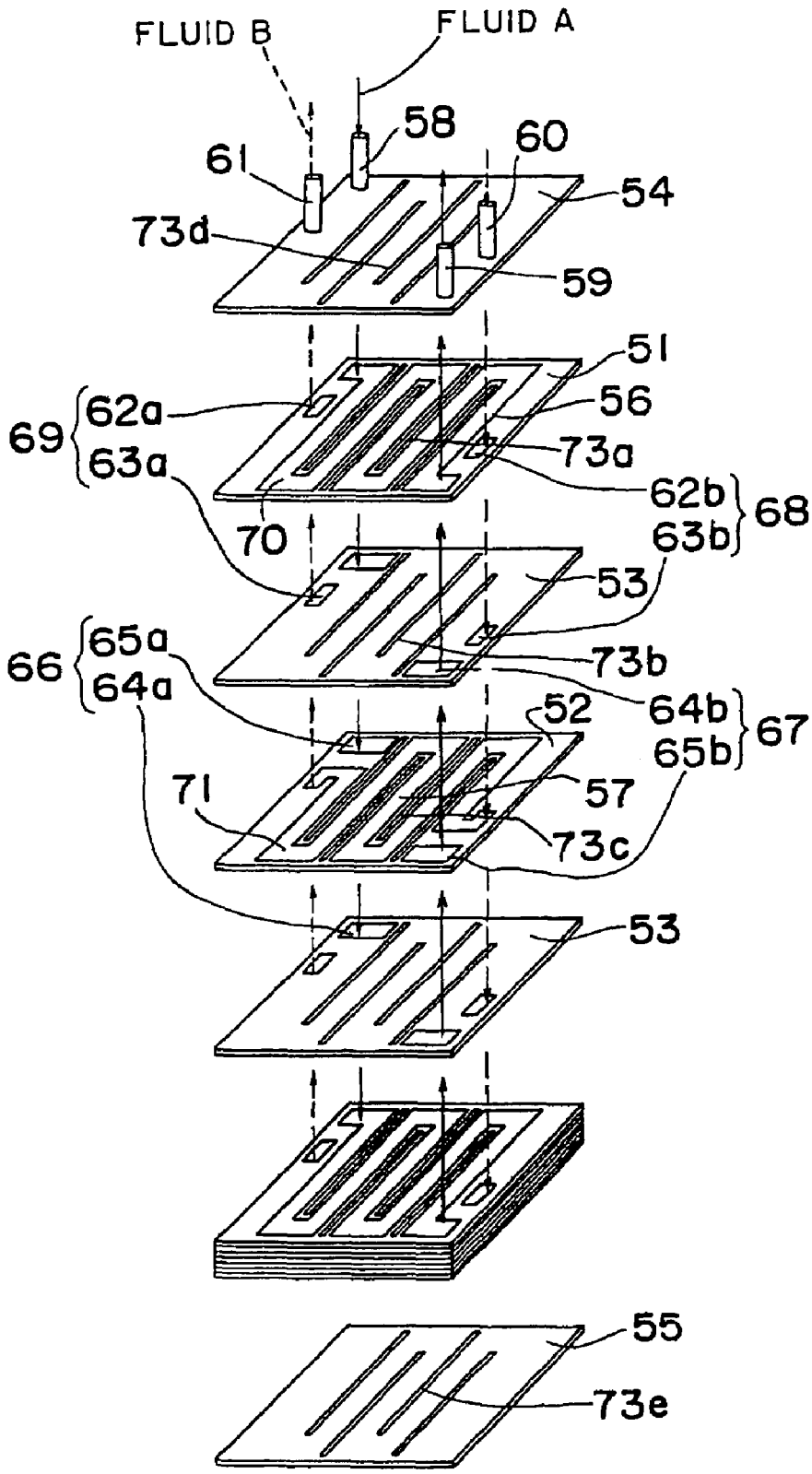
FIG. 5 is an exploded perspective view of a plate heat exchanger according to a fourth embodiment of the present invention.

FIG. 5 depicts a plate heat exchanger according to a fourth embodiment of the present invention.

This plate heat exchanger has substantially the same construction as that shown in FIG. 1 and includes a plurality of passageway plates 51 each having a passageway 56 defined therein as a penetration for the passage of a heat exchange fluid A, and a plurality of passageway plates 52 each having a passageway 57 defined therein as a penetration for the passage of a heat exchange fluid B. These passageway plates 51, 52 are piled up alternately and sandwiched between a pair of end plates 54, 55, with a partition plate 53 interposed between adjacent passageway plates 51, 52. The passageways 56, 57 have generally U-shaped turning portions 70, 71, respectively. In addition, each of the passageway plates 51 has a plurality of through-holes or slots 73*a* defined therein between adjacent fluid paths of the passageway 56 (between the upstream and downstream sides of each turning portion 70), while each of the partition plates 53 and each of the passageway plates 52 have respective through-holes or slots 73*b*, 73*c* aligned with the through-holes 73*a* so as to communicate therewith. The end plates 54, 55 similarly have respective throughholes or slots 73*d*, 73*e* aligned with the through-holes 73*a*, 73*b*, 73*c*.

Each passageway plate 51 has through-holes 62*a*, 62*b* defined therein in addition to the passageway 56, while each passageway plate 52 similarly has through-holes 65*a*, 65*b* defined therein in addition to the passageway 57. Each partition plate 53 has through-holes 63*a*, 63*b*, 64*a*, 64*b* defined therein. When the passageway plates 51, 52 are piled up (stacked) with a partition plate 53 interposed therebetween, an inlet header or space 66 for the heat exchange fluid A is formed by a portion of each passageway 56 and the through-holes 64*a*, 65*a*. An outlet header 67 for the heat exchange fluid A, an inlet header 68 for the heat exchange fluid B, and an outlet header 69 for the heat exchange fluid B are similarly formed.

The end plate 54 has inlet and outlet pipes 58, 59 for the heat exchange fluid A, and inlet and outlet pipes 60, 61 for the heat exchange fluid B, all of which are secured thereto. The inlet and outlet pipes 58, 59 are in fluid communication with the inlet and outlet headers 66, 67 for the heat exchange fluid A, respectively. Similarly, the inlet and outlet pipes 60, 61 are in fluid communication with the inlet and outlet headers 68, 69 for the heat exchange fluid B, respectively.

The heat exchange fluid A enters the inlet header 66 through the inlet pipe 58 secured to the end plate 54, and then enters the passageways 56 formed in the passageway plates 51. The heat exchange fluid A that has passed through the passageways 56 is collected in the outlet header 67 and is discharged outside through the outlet pipe 59. On the other hand, the heat exchange fluid B enters the inlet header 68 through the inlet pipe 60 secured to the end plate 54, and then enters the passageways 57 formed in the passageway plates 52. The heat exchange fluid B that has passed through the passageways 57 is collected in the outlet header 69 and is discharged outside through the outlet pipe 61. At this moment, the heat exchange fluid A flowing through each passageway 56 exchanges heat, through the two partition plates 53 disposed above and below it, with the heat exchange fluid B flowing through the passageways 57.

As shown in FIG. 5, where the passageways 56 have the generally U-shaped turning portions 70, the heat exchange fluid A that flows through a fluid path of one of the passageways 56 not only exchanges heat with the heat exchange fluid B through the partition plates 53, but also has a good chance to exchange heat with the heat exchange fluid A that flows through neighboring fluid paths of such one of the passageways 56. In this embodiment, however, because a through-hole 73*a* is formed between the neighboring fluid paths of each passageway 56, heat transfer at such portion is completely blocked. The same is true for the passageways 57.

By the above-described construction, heat exchange between the neighboring fluid paths of each passageway is completely blocked, making it possible to further enhance the performance of the plate heat exchangers.

In the plate heat exchanger shown in FIG. 3 also, the same effects can be obtained if a through-hole is provided between neighboring fluid paths of the same passageway 34 or 35.

Embodiment 5

A method of making the plate heat exchangers according to the first to fourth embodiments of the present invention (shown in FIGS. 1 to 5) is discussed hereinafter in detail. It is assumed that all the plates are made of metallic material having superior heat transfer properties such, for example, as stainless steel, copper, aluminum or the like.

Figure 6:
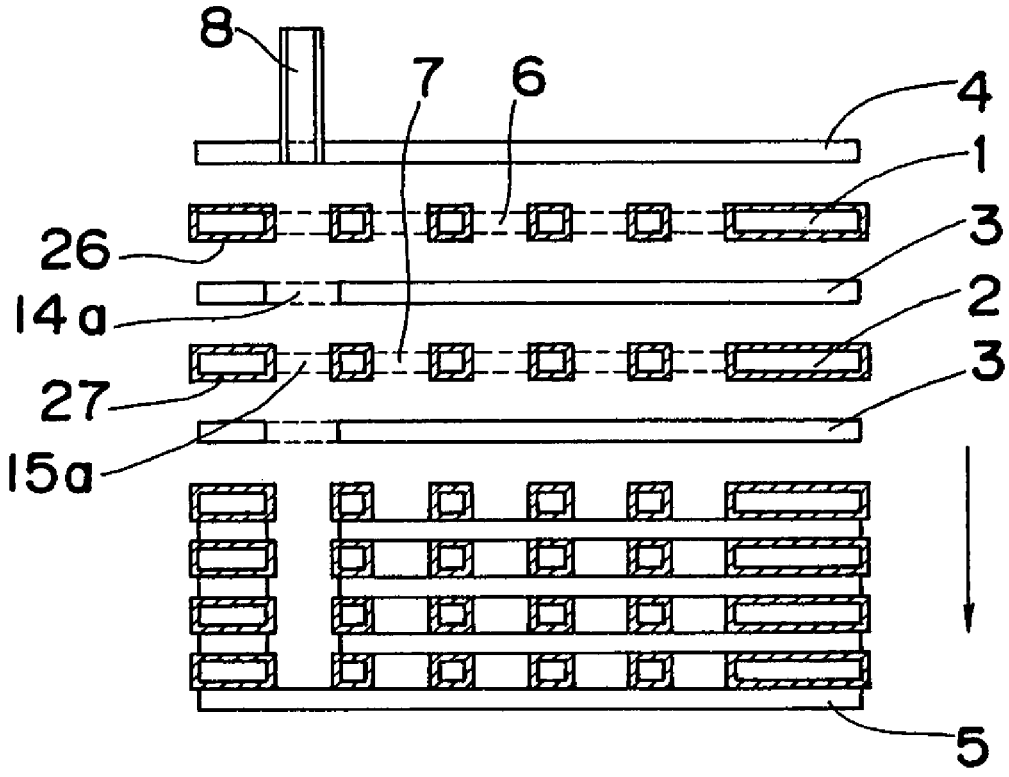
FIG. 6 is a sectional view taken along line VI—VI in FIG. 1, depicting a method of making a plate heat exchanger.

FIG. 6 is a sectional view taken along the line VI—VI in the plate heat exchanger of FIG. 1 and clearly depicts the position of solder or plating material when the plates are piled up (stacked). The passageway plates 1, 2 covered entirely with deposits 26, 27 are piled up one above the other between the upper and lower end plates 4, 5 with a partition plate 3 interposed between neighboring passageway plates 1, 2.

Openings, which include the passageways and the through-holes, are first formed in the passageway plates 1, 2 and the partition plates 3 by a pressing procedure that is superior for mass-productivity.

Subsequently, plating is performed on the surfaces of the passageway plates 1, 2 in which the passageways and the through-holes have already been formed. If the plates are made of stainless steel that is superior in resistance to corrosion, it is sufficient if the plating is performed using mainly nickel and phosphorus, for example. This plating is generally electroless plating. If the plates are made of copper having a high heat transfer rate, it is sufficient if the plating is performed using mainly silver, for example.

Furthermore, all the plates are piled up so that the punching directions thereof during pressing may coincide as shown by an arrow in the figure.

Finally, the deposits are fused to join the plates together by heating the plates held in close contact with one another.

At this moment, the plates that have been processed by pressing are piled up so that burrs formed during pressing may protrude in the same direction. Accordingly, deterioration in the degree of contact between neighboring plates, which has been hitherto caused by contact between the burrs, is avoided, and the plates are positively joined together by plating and subsequent brazing, making it possible to enhance the yield and provide highly reliable plate heat exchangers.

The same effects can be obtained with respect to the plate heat exchanger shown in FIG. 3, if it is made by a method including the steps of: shaping the passageway plates 31 by pressing; performing plating on the opposite surfaces of the passageway plates 31; piling up the passageway plates 31 so that the punching directions thereof during pressing may coincide; and heating the piled passageway plates 31 under the condition in which they are held in close contact with one another.

Embodiment 6

Figure 7:
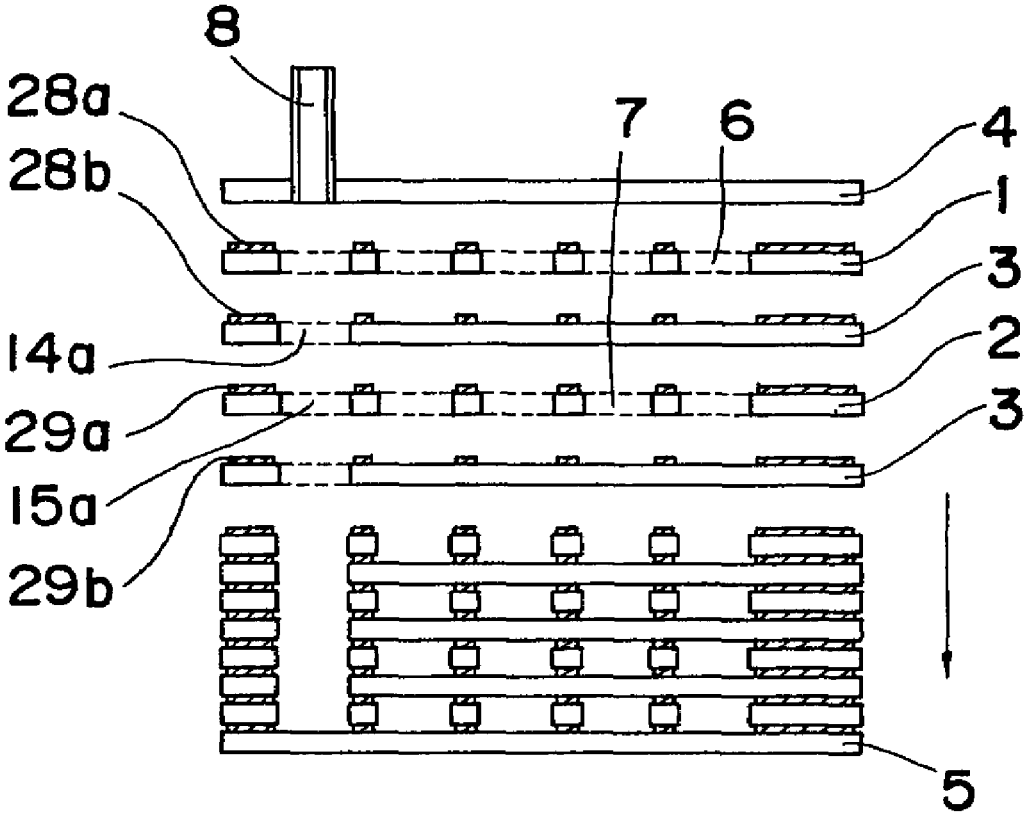
FIG. 7 is a sectional view taken along line VI—VI in FIG. 1, depicting another method of making a plate heat exchanger.
Figure 8:
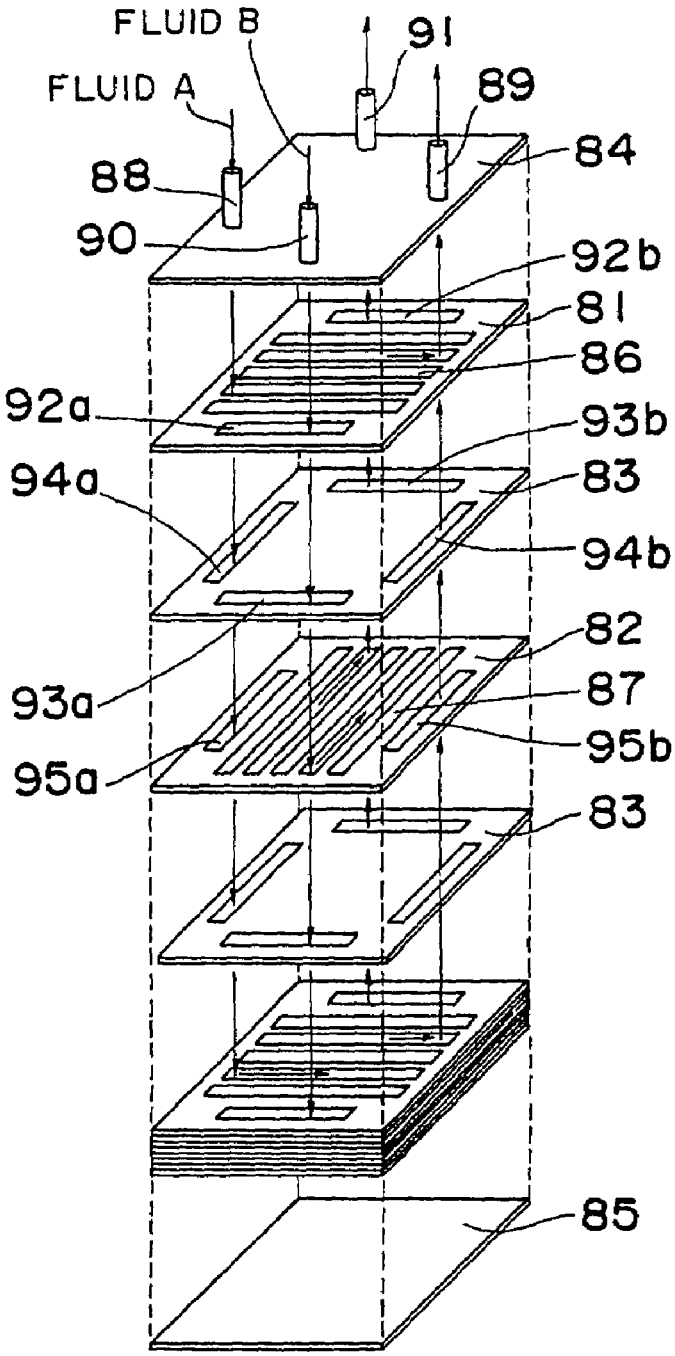
PRIOR ART Fig. 8
FIG. 8 is an exploded perspective view of a conventional plate heat exchanger.

FIG. 7 depicts another method of making the plate heat exchangers according to the first to fourth embodiments of the present invention. The passageway plates 1, 2 (of which only the upper surfaces are coated with solder or brazing material) are piled up one above the other between the upper and lower end plates 4, 5 with a partition plate 3, of which only the upper surface is similarly coated with solder or brazing material, interposed between neighboring passageway plates 1, 2.

The passageways and the through-holes are first formed in the passageway plates 1, 2 and the partition plates 3 by a pressing procedure that is superior for mass-productivity.

Subsequently, the plates are coated with solder. Paste solder in which powdered solder is mixed with a binder is preferably used for the solder. The coating of the paste solder is performed by a printing method such as a silk-screen process with the use of a coating mask. In this embodiment, the upper surfaces of the passageway plates 1 and those of the partition plates 3 disposed below them are coated with solder 28*a* and solder 28*b*, respectively, using masks that have openings of substantially the same shape as that of the openings of the passageway plates 1. The coating of the solder is performed on the surfaces (upper surfaces in the figure) positioned on the upstream side of the plates in the punching directions thereof during pressing. Similarly, the upper surfaces of the passageway plates 2 and those of the partition plates 3 disposed below them are coated with solder 29*a* and solder 29*b*, respectively, using masks that have openings of substantially the same shape as that of the openings of the passageway plates 2. Where the plates are made of stainless steel, nickel is preferably used for the solder, and where the plates are made of copper, silver or phosphor, copper is preferably used for the solder.

Furthermore, all the plates are piled up so that the punching directions thereof during pressing may coincide as shown by an arrow in the figure.

Finally, the solder component in the paste solder is fused to join the plates together by heating the plates held in close contact with one another.

As a result, the plates are positively joined together by brazing using the paste solder. The use of the paste solder that is cheaper than plating reduces the manufacturing cost of the heat exchangers. Also, because the solder is coated on the surfaces of the plates on which no burrs project, jigs or tools such as masks to be used during coating are not appreciably damaged by the burrs, thus enhancing the reliability of the plate heat exchangers.

The same effects can be obtained with respect to the plate heat exchanger shown in FIG. 3, if it is made by a method including the steps of: shaping the passageway plates 31 by pressing; coating with paste solder the surfaces of the passageway plates 31 that are positioned on the upstream side of the plates in the punching directions during pressing; piling up (stacking) the passageway plates 31 so that the punching directions thereof during pressing may coincide; and heating the piled passageway plates 31 under the condition in which they are held in close contact with one another.

It is to be noted that although in Embodiments 5 and 6 it is assumed that all the plates are made of metallic material, at least the passageway plates may be made of resinous material having a small specific gravity such, for example, as Teflon sheets depending on the pressure resistance and the heat resistance of the heat exchangers.

The use of such material reduces the weight of the plate heat exchangers. In this case, if the partition plates 3 are made of metallic material that is superior in heat transfer efficiency to the resinous material, heat transfer between the heat exchange fluids A and B is not deteriorated. Where the passageway plates are made of resinous material, bonding or welding is preferably used in place of the brazing in manufacturing the plate heat exchangers. The use of the resinous material can reduce the weight and size of the heat exchangers while maintaining the heat transfer efficiency, compared with the plate heat exchangers in which all the plates are made of metallic material.

It is to be noted that all the plates may be made of resinous material according to the use environment of the heat exchangers.

What is claimed is:

1. A plate heat exchanger comprising:

a pair of end plates;

a plurality of first passageway plates each having a first passageway defined therein;

a plurality of second passageway plates each having a second passageway defined therein;

a plurality of partition plates, said plurality of first passageway plates and said plurality of second passageway plates being stacked in an alternating manner with one of said plurality of partition plates interposed between each adjacent first passageway plate and second passageway plate, and said first passageway of each of said first passageway plates and said second passageway of each of said second passageway plates being aligned, whereby a first fluid flowing through said first passageway of each of said first passageway plates flows in a manner that is countercurrent to a flow of a second fluid flowing through said second passageway of each of said second passageway plates; and a partition member arranged in only said first passageway of each of said first passageway plates so as to divide said first passageway into two sections with respect to a widthwise direction of said first passageway.

2. The plate heat exchanger of claim 1, wherein each of said partition plates has a thickness greater than a thickness of any one of said first passageway plates and said second passageway plates.

3. The plate heat exchanger of claim 2, wherein said first passageway of each of said first passageway plates and said second passageway of each of said second passageway plates have generally U-shaped turning portions.

4. The plate heat exchanger of claim 1, wherein said first passageway of each of said first passageway plates and said second passageway of each of said second passageway plates have generally U-shaped turning portions.

5. The plate heat exchanger of claim 4, wherein each of said first passageway plates, said second passageway plates, and said partition plates has a plurality of header through-holes formed therein and arranged so as to form an inlet header and an outlet header in said plate heat exchanger.

6. A method of making a plate heat exchanger, comprising:

shaping a plurality of plates by pressing to form openings through each of the plates, said pressing comprising pressing against a first surface of each of the plates toward a second surface of each of the plates;

coating solder paste on the first surface of each of the plates;

stacking the plates immediately adjacent to each other so that the second surface of each plate does not adjoin the second surface of an adjacent plate, whereby the plates are oriented in the same direction with respect to the first surface and the second surface of each of the plates; and heating the plates while holding the plates in close contact with each other;

wherein said shaping of the plates comprises forming a group of first passageway plates, a group of second passageway plates, and a group of partition plates, wherein the openings formed in the group of first passageway plates comprise first passageways and through-holes, the openings formed in the group of second passageway plates comprise second passageways and through-holes, and the openings formed in the group of partition plates comprise through-holes.

7. The method of claim 6, wherein said stacking of the plates comprises stacking the plates in an alternating manner so that one of the group of partition plates is interposed between each adjacent first passageway plate and second passageway plate.

8. A method of making a plate heat exchanger, comprising:

shaping a plurality of plates by pressing to form openings through each of the plates, said pressing comprising pressing against a first surface of each of the plates toward a second surface of each of the plates;

coating solder paste on the first surface of each of the plates;

stacking the plates immediately adjacent to each other so that the second surface of each plate does not adjoin the second surface of an adjacent plate, whereby the plates are oriented in the same direction with respect to the first surface and the second surface of each of the plates; and heating the plates while holding the plates in close contact with each other;

wherein the plurality of plates includes at least three plates, including a first passageway plate, a second passageway plate, and a partition plate, wherein said stacking of the plates comprises stacking the plates so that the partition plate is located between the first passageway plate and the second passageway plate, and so that a second surface of the first passageway plate adjoins a first surface of said partition plate, and a second surface of the partition plate adjoins a first surface of the second passageway plate.

9. The method of claim 8, wherein the openings through the first passageway plate comprise a first passageway and through-holes, the openings through the second passageway plate comprise a second passageway and through-holes, and the openings in the partition plate comprise through-holes.

* * * * *